US009416543B1

(12) United States Patent
Fox et al.

(10) Patent No.: US 9,416,543 B1
(45) Date of Patent: Aug. 16, 2016

(54) DOWNSPOUT DEBRIS TRAP

(71) Applicant: Englert Inc., Perth Amboy, NJ (US)

(72) Inventors: Michael Fox, Perth Amboy, NJ (US); David Plum, Perth Amboy, NJ (US)

(73) Assignee: Englert Inc., Perth Amboy, NJ (US)

( * ) Notice: Subject to any disclaimer, the term of this patent is extended or adjusted under 35 U.S.C. 154(b) by 211 days.

(21) Appl. No.: 14/106,211

(22) Filed: Dec. 13, 2013

(51) Int. Cl.
*E04D 13/08* (2006.01)
*E04D 13/076* (2006.01)

(52) U.S. Cl.
CPC ..... *E04D 13/0767* (2013.01); *E04D 13/076* (2013.01)

(58) Field of Classification Search
CPC ..... E04D 13/076; E04D 13/0725; E04D 13/0767; E04D 13/0413; B01D 2221/12
USPC ..... 52/12, 16; 210/162, 163, 170.03, 459, 210/463, 747.3
See application file for complete search history.

(56) References Cited

U.S. PATENT DOCUMENTS

| | | | | |
|---|---|---|---|---|
| 3,990,474 | A * | 11/1976 | Harms | 137/873 |
| 4,470,908 | A * | 9/1984 | Odekirk | 210/463 |
| 4,801,377 | A * | 1/1989 | Bolt | 210/162 |
| 5,230,798 | A * | 7/1993 | Rogman | 210/447 |
| 8,656,947 | B1 * | 2/2014 | Barton | 137/544 |
| 8,715,495 | B1 * | 5/2014 | Smith | 210/162 |
| 2007/0175106 | A1 * | 8/2007 | Rotter | 52/12 |
| 2008/0086953 | A1 * | 4/2008 | Graf | 52/12 |
| 2008/0229673 | A1 * | 9/2008 | LaMorte et al. | 52/12 |

* cited by examiner

*Primary Examiner* — Brian Glessner
*Assistant Examiner* — Paola Agudelo
(74) *Attorney, Agent, or Firm* — Schwegman Lundberg & Woessner, P.A.

(57) ABSTRACT

A debris trap device for diverting rainwater collected from a gutter to the ground and/or into an underground water storage and drainage system. The debris trap device can include a conduit defining a channel and having an inlet opening to receive fluid and debris and an outlet opening to discharge the fluid, a trap having a plurality of apertures extending from a superior surface to an inferior surface, where the trap is located within the channel and coupled to the conduit, a first panel removably coupled to the first wall, and a second panel removably coupled to the second wall.

16 Claims, 8 Drawing Sheets

DOWNSPOUT DEBRIS TRAP

BACKGROUND

Gutter systems can include gutters and downspouts that can be used to collect and divert fluid (e.g., rainwater) away from building structures. Gutters are typically open channel devices attached to building structures adjacent to a roof edge to collect rainwater deposited on the roof. Downspouts are typically closed conduits that can divert rainwater collected from a gutter on the building structures to the ground and/or into an underground water storage and drainage system. Gutters are often exposed to loose debris. The rainwater introduced into the gutters and directed through the downspout can often contain debris such as leaves, sticks, and other debris that has accumulated on the roof and is washed into the gutter.

The debris can often accumulate and clog the downspout and/or an underground water storage and drainage system that may be connected to the downspout. Clogging of the downspout and/or the underground water storage and drainage system can prevent the downspout from directing the rainwater away from the building structure and can cause damage. For example, a clogged downspout may cause the rainwater to backup within the downspout and overflow the edges of the gutters and along the walls of the building, thereby damaging or defacing the building structure. A clogged underground water and drainage system can be difficult to clear and can cause overflow and prevent proper function of the gutter system.

OVERVIEW

The present disclosure is directed to debris trap devices and methods for making the debris trap devices. Using the debris trap device of the present disclosure can provide an aesthetically pleasing debris trap that also allows a user to quickly and easily clean out a clogged downspout. Additionally, the debris trap device of the present disclosure can minimize debris falling below the debris trap during cleanout, which may result in clogging of a water storage and drainage system. The debris trap of the present disclosure can also minimize damage to the trap during cleanout, which could otherwise compromise the performance of the debris trap device.

The present inventors have recognized, among other things, that existing systems for catching debris in downspouts fail to provide users with a debris trap that can quickly and easily be cleaned out while minimizing the risk of damage to the debris trap. The present inventors have further recognized that existing systems for catching debris can limit the size of debris captured and increase the risk of debris falling below the debris trap device during cleanout. For example, existing systems can include a removable screen (e.g., a pocket), where a funneling (e.g., necking) of the downspout directs rainwater and debris into the screen. During cleanout, the screen is removed from the downspout. Removing the screen from the downspout can be difficult, can cause damage to the screen, and can allow debris to fall below the screen. For example, the risk of bending and damaging the screen can be increased when the screen is removed. Bending and damaging of the screen can create gaps that can allow for debris to pass when the screen is in use, thereby, compromising the ability of the screen to function properly. Removing the screen while there is collected debris can increase the risk of the debris falling below the screen as the screen is removed. Further, the funnel-shaped (e.g., necking) design of existing devices can limit the size of debris captured by the screen. For example, debris larger than a diameter of the funneled portion of the downspout can collect above the screen. The debris collected above the screen can be difficult to remove and can limit the flow of water through the downspout.

The present devices and methods provide a debris trap device. The debris trap device can include two opposing removable panels and a trap coupled to an inside of the downspout section containing the debris trap. The two opposing removable panels can allow access to the interior of the downspout above the trap and permit easy cleanout by blowing or spraying through one panel, across the trap, and out the opposing panel. The trap is separate from the panels such that when the panels are removed for cleanout, the trap remains coupled to and positioned within the downspout. By keeping the trap coupled to and positioned within the downspout during cleanout, the risk of built-up debris falling below the trap is minimized and the risk of damaging and/or bending the trap is also minimized. Further, by coupling the trap to the inside of the downspout, the surface area of the trap can be substantially similar to a cross-sectional area of the downspout. Maximizing the surface area of the trap can minimize debris getting caught above the trap and allow for a greater volume of water flow during heaving rainfall.

To better illustrate the debris trap device and methods disclosed herein, a non-limiting list of examples is provided here:

Example 1 includes subject matter directed to a debris trap device. The debris device trap can include a conduit defining a channel forming an inlet opening to receive fluid and debris and an outlet opening to discharge at least the fluid, the conduit including a first wall defining a first aperture and a second wall defining a second aperture directly opposite of the first aperture, a trap including a superior surface, an inferior surface, and a plurality of apertures extending from the superior surface to the inferior surface, the trap positioned within the channel and coupled to the conduit such that the superior surface is substantially flush with a first lower edge of the first aperture and a second lower edge of the second aperture, a first panel reversibly removably coupled to the first aperture, and a second panel reversibly removably coupled to the second aperture.

In Example 2, the subject matter of Example 1 can optionally include where the trap includes a first indentation along a first side of the trap and a second indentation along a second side of the trap, the second side directly opposite the first side.

In Example 3, the subject matter of one or any combination of Examples 1-2 can optionally include where the first side is positioned adjacent to the first wall of the conduit and the second side is positioned adjacent to the second wall of the conduit.

In Example 4, the subject matter of one or any combination of Examples 1-3 optionally include where a first indentation length is at least equal to a first aperture width and a second indentation length is at least equal to a second aperture width.

In Example 5, the subject matter of one or any combination of Examples 1-4 can optionally include where a first gap is formed between the first wall and the first indentation and a second gap is formed between the second wall and the second indentation.

In Example 6, the subject matter of one or any combination of Examples 1-5 optionally includes where the trap includes a first tab extending from the inferior surface along a third side of the trap and a second tab extending from the inferior surface along a fourth side of the trap.

In Example 7, the subject matter of one or any combination of Examples 1-6 can optionally include where the first tab and the second tab extend in a direction that is substantially perpendicular to the inferior surface and substantially parallel to a longitudinal axis of the conduit.

In Example 8, the subject matter of one or any combination of Examples 1-7 can optionally include where the first tab is coupled to a third wall of the conduit and the second tab is coupled to a fourth wall of the conduit, the third wall directly opposite of the fourth wall.

In Example 9, the subject matter of one or any combination of Examples 1-8 can optionally include where the first panel and the second panel include a first segment coupled to a second segment.

Example 10, the subject matter of one or any combination of Examples 1-9 can optionally include where the second segment includes a first recessed portion and a second recessed portion.

In Example 11, the subject matter of one or any combination of Examples 1-10 can optionally include where the first panel and the second panel include a first panel gap at a first end of the first panel and a first end of the second panel and a second panel gap at a second end of the first panel and a second end of the second panel.

In Example 12, the system of one or any combination of Examples 1-11 can optionally include where a first panel gap width is greater than a first wall thickness and a second panel gap width is greater than a second wall thickness.

In Example 13, the system of one or any combination of Examples 1-12 can optionally include where the first panel and the second panel include a protrusion extending from a top surface of the first segment.

Example 14 includes subject matter directed to a downspout system. The downspout system can include a downspout defining a channel and having a first inlet opening configured to be coupled to a gutter and to receive fluid and debris collected in the gutter and a first outlet opening to discharge the fluid from the downspout and a debris trap device coupled to the downspout. The debris trap device includes a conduit defining a channel forming a second inlet opening and a second outlet opening, the second inlet opening coupled to a first portion of the downspout and the outlet opening coupled to a second portion of the downspout, a first wall of the debris trap device defining a first aperture and a second wall of the debris trap device defining a second aperture, the second aperture directly opposite the first aperture, a trap including a superior surface, an inferior surface, and a plurality of apertures extending from the superior surface to the inferior surface, the trap positioned within the channel and coupled to the conduit, a first panel removably coupled to the first wall, and a second panel removably coupled to the second wall, where the debris trap device is positioned between the first inlet opening of the downspout and the first outlet opening of the downspout.

In Example 15, the system of one or any combination of Examples 10-14 can optionally include where the superior surface of the trap is substantially flush with a first lower edge of the first aperture and a second lower edge of the second aperture.

Example 16 is directed toward a method. The method includes providing a conduit defining a channel, the conduit having a first wall defining a first aperture and a second wall defining a second aperture, wherein the first aperture is directly opposite the second aperture, positioning a trap within the channel, the trap having a superior surface, an inferior surface, and a plurality of apertures extending from the superior surface to the inferior surface, coupling the trap to the conduit such that the superior surface, a first lower edge of the first aperture, and a second lower edge of the second aperture are positioned along a common plane extending perpendicular to a longitudinal axis of the conduit, providing a first panel that is removably coupled to the first wall, and providing a second panel that is removably coupled to the second wall.

In Example 17, the subject matter of one or any combination of Examples 1-16 can optionally include where the trap includes a first indentation along a first side of the trap and a second indentation along a second side of the trap, the second side directly opposite the first side.

In Example 18, the subject matter of one or any combination of Examples 1-17 can optionally include where the trap includes a first tab extending from the inferior surface along a third side of the trap and a second tab extending from the inferior surface along a fourth side of the trap, the fourth side directly opposite the third side.

In Example 19, the subject matter of one or any combination of Examples 16-18 can optionally include where positioning the trap within the channel includes positioning the first side of the trap adjacent to the first wall of the conduit and positioning the second side of the trap adjacent to the second wall of the conduit.

In Example 20, the subject matter of one or any combination of Examples 16-19 can optionally include where coupling the trap to the conduit includes coupling the first tab to a third wall of the conduit and coupling the second tab to a fourth wall of the conduit, wherein the third wall is directly opposite the fourth wall.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
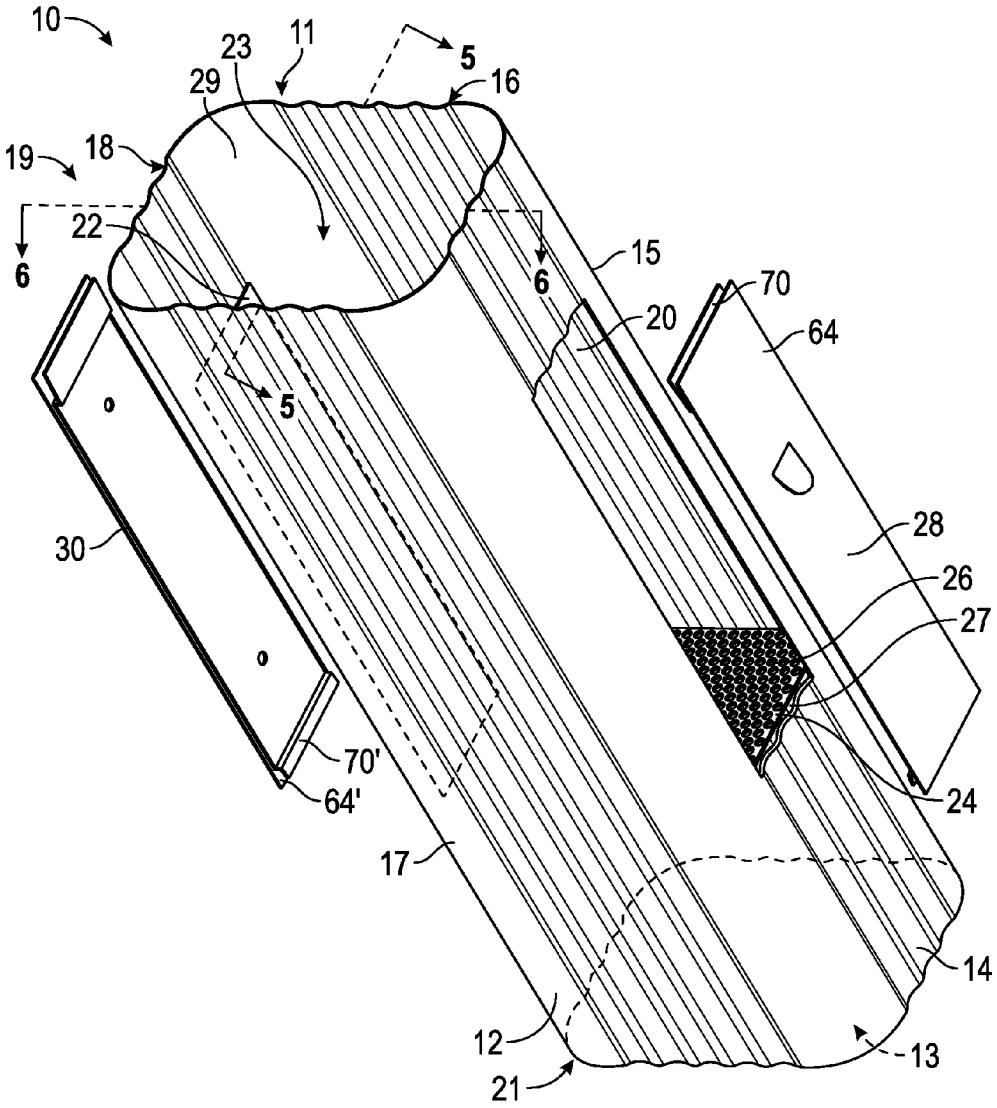
FIG. 1 illustrates a partially exploded view of a debris trap device, as constructed in accordance with at least one example.

FIG. 1 illustrates a partially exploded view of a debris trap device 10, in accordance with at least one example of the present disclosure. The debris trap device 10, according to the present disclosure, can be used to collect and remove debris contained in rainwater introduced into a downspout. The debris trap device 10 can be formed integrally with a downspout or coupled to an existing downspout.

The debris trap device 10 can include a conduit 15 (e.g., a downspout), a trap 24, a first panel 28, and a second panel 30. The conduit 15 can have an interior surface 29 that defines a channel 23 extending from a first end 19 of the conduit 15 to a second end 21 of the conduit 15. The first end 19 can define an inlet opening 11 configured to receive fluid (e.g., rainwater) and debris (e.g., leaves and sticks, etc.). The second end 21 can define an outlet opening 13 configured to discharge at least the fluid. For example, the outlet opening 13 can discharge the fluid and debris small enough to pass through the trap 24 (e.g., sand and small rocks, etc.). In an example, the first end 19 can be coupled to a gutter such that the inlet opening 11 receives the fluid and debris from the gutter. In another example, the first end 19 can be coupled to a portion of an existing downspout such that the inlet opening 11 receives the fluid and debris from the downspout.

The conduit 15 can include a first wall 14 including a first aperture 20 and a second wall 18 including a second aperture 22. The first aperture 20 and the second aperture 22 can extend from an external surface 17 of the conduit 15 to the interior surface 29. As shown in FIG. 1, the first aperture 20 can be directly opposite of the second aperture 22. As discussed herein, the shape and size of the first aperture 20 and the second aperture 22 can be substantially the same to facilitate removing collected debris from the debris device trap 10.

As shown in the example illustrated in FIG. 1, the conduit 15 (e.g., the downspout) has a rectangular shape including the first wall 14, the second wall 18, a third wall 12, and a fourth wall 16. The first wall 14 and second wall 18, including the first and second apertures 20, 22, are directly opposite of each other. In an example when the conduit 15 has a rectangular shape, the first and second walls 14, 18 can have a width that is less than a width of the third and fourth walls 12, 16. For example, the first and second walls 14, 18 can have a width of about two inches to about three inches and the third and fourth walls 12, 16 can have a width of about three inches to about four inches. That is, the dimensions of the conduit 15 can be two inches by three inches or three inches by four inches. However, the conduit 15 can be constructed with other dimensions and still include similar debris trap structures.

In an example, the first and second walls 14, 18 can be positioned perpendicular to a surface of a building and the third and fourth walls 12, 16 can be positioned parallel to the surface of the building. Having the first and second apertures 20, 22 and the corresponding panels 28, 20 positioned on the sides of the conduit 15 perpendicular to the surface of the building can provide an aesthetically pleasing debris trap device 10 as the panels 28, 30 are less visible. A perpendicular positioning of apertures 20, 22 can also facilitate clean-out. While FIG. 1 illustrates a conduit 15 having the shape of a rectangle, other shapes such as a square, can be used. Further, while the conduit 15 in FIG. 1 illustrates two apertures (e.g., the first aperture 20 and the second aperture 22), additional apertures can be utilized, for example, an aperture on the third wall 12 and/or the fourth wall 16.

Figure 5:
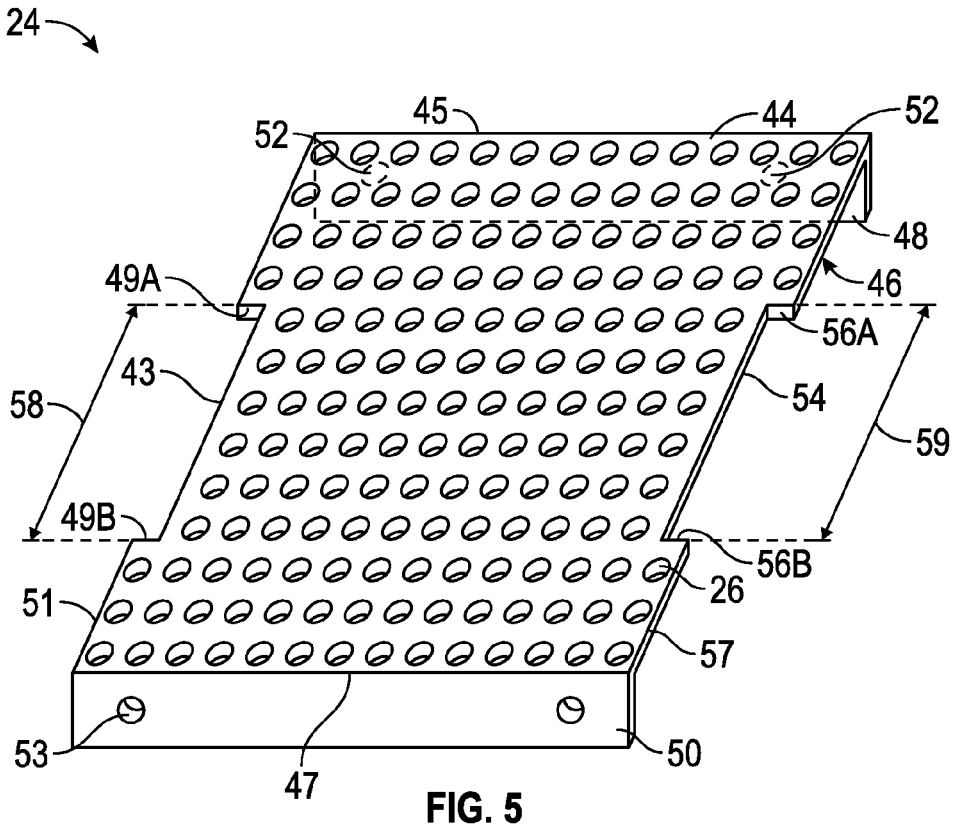
FIG. 5 illustrates a perspective view of a trap, as constructed in accordance with at least one example.

The trap 24 can include a superior surface 44 and an inferior surface 46 (as shown in FIG. 5). The trap 24 can include a plurality of apertures 26 extending from the superior surface 44 to the inferior surface 26 (also illustrated in FIG. 5). As discussed herein, the trap 24 can be located within the channel 23 and can be coupled to the conduit 15. Coupling the trap 24 to the conduit 15 can allow a user to remove the collected debris without removing the trap 24, which can minimize damage to the trap 24 and minimize collected debris from falling beneath the trap 24 during cleanout.

Figure 6:
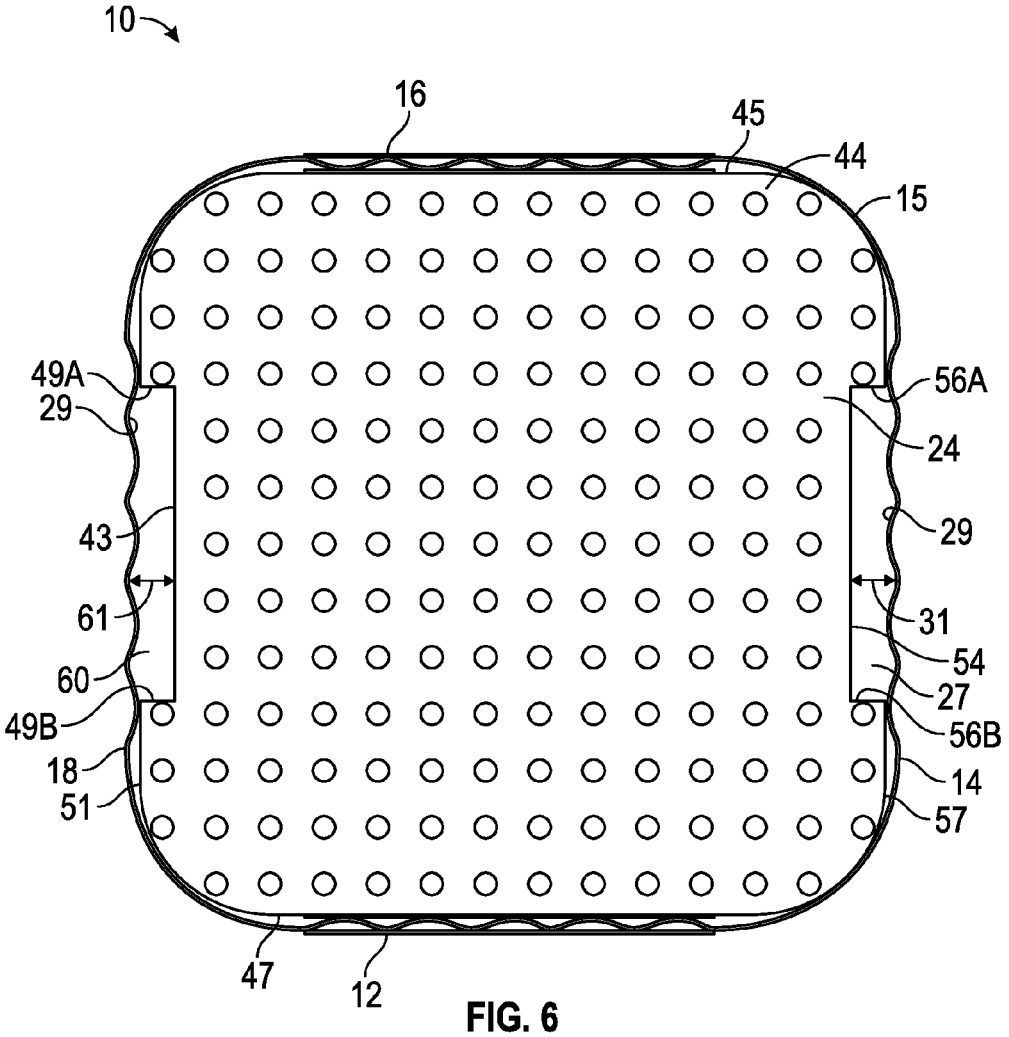
FIG. 6 illustrates a top-down view of the debris trap device, as constructed in accordance with at least one example.

The first panel 28 can be removably coupled to the first wall 14 and the second panel 30 can be removably coupled to the second wall 18. That is, the first panel 28 can be coupled to the first wall 14 in a removable manner and the second panel 30 can be coupled to the second wall 18 in a removable manner. In an example, the first and second panel 28, 30 can be substantially identical to each other. In an example, the first panel 28 can include a first segment 64 coupled to a second segment 70. In an example, the second panel 30 can include a first segment 64' coupled to a second segment 70'. As discussed herein, a first gap 27 configured to receive a portion of the second segment 70 of the first panel 28 can be formed between the conduit 15 and the trap 24. For example, an indentation 54 in the trap 24 can form the first gap 27 between the conduit 15 and the trap 24 (as shown in FIGS. 5 and 6). Additionally, an indentation 43 in the trap 24 can form a second gap 60 between the conduit 15 and the trap 24 (as shown in FIGS. 5 and 6). The second gap 60 can configured to receive a portion of the second segment 70' of the second panel 30 can be formed between the conduit 15 and the 24 (as shown in FIG. 6). In an example, to remove collected debris during cleanout, the first panel 28 and the second panel 30 can be removed and the collected debris collected on the superior surface 44 of the trap 24 can be removed via blowing and/or spraying.

Figure 2:
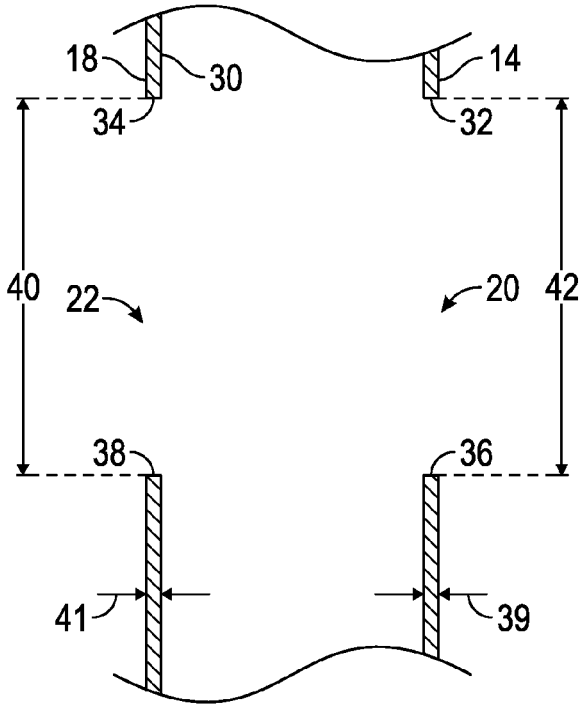
FIG. 2 illustrates a cross-sectional view of a conduit, as constructed in accordance with at least one example.

FIG. 2 illustrates a cross-sectional view of a conduit 15, in accordance with at least one example of the present disclosure. As illustrated in FIG. 2, the first wall 14 includes the first aperture 20 and the second wall 18 includes the second aperture 22. The first aperture 20 can define a first lower edge 36 and a first upper edge 32. The second aperture 22 can define a second lower edge 38 and a second upper edge 34. A first aperture length 42 and a second aperture length 40 can be substantially the same. The conduit 15 can include a first wall thickness 39 and a second wall thickness 41. In an example, the first wall thickness 39 and the second wall thickness 41 can be substantially the same.

Figure 3:
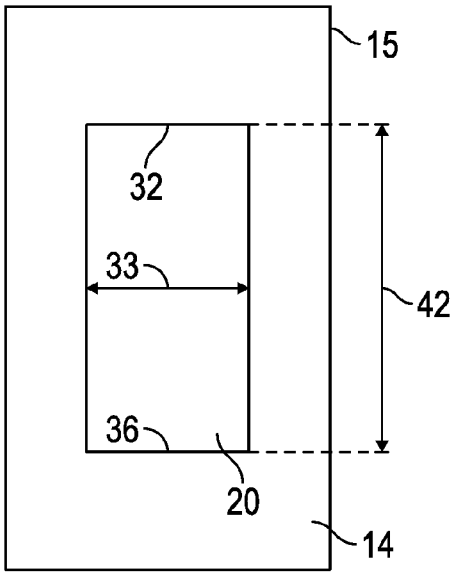
FIG. 3 illustrates a first wall of a conduit including a first aperture, as constructed in accordance with at least one example.
Figure 4:
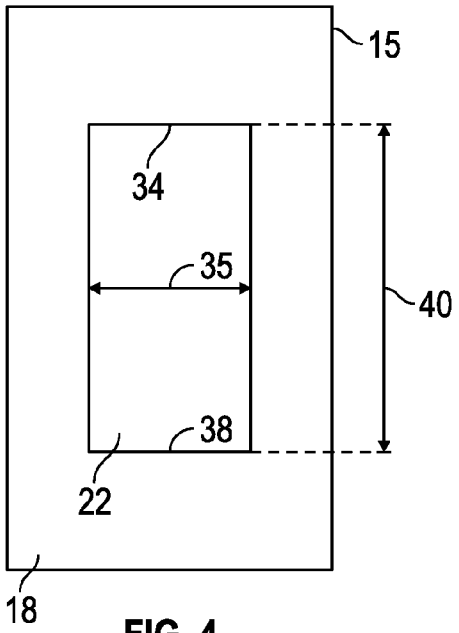
FIG. 4 illustrates a second wall of the conduit including a second aperture, as constructed in accordance with at least one example.

FIG. 3 illustrates the first wall 14 of a conduit 15 including the first aperture 20, in accordance with at least one example of the present disclosure. FIG. 4 illustrates the second wall 18 of a conduit 15 including the second aperture 22, in accordance with at least one example of the present disclosure. As illustrated in FIGS. 3 and 4, the first and second apertures 20, 22 can be substantially the same. That is, the shape and size of the first and second apertures 20, 22 can be identical. In an example, a first aperture width 33 and a second aperture width 35 can be substantially the same. In an example, the first lower edge 36 of the first aperture 20 and the second lower edge 38 of the second aperture 22 can be substantially flush with each other. "Substantially flush," as used herein, can refer to surfaces or objects being even or level with other surfaces or objects. In other words, substantially flush surfaces or objects can be positioned along a common plane. In an example, the first upper edge 32 of the first aperture 20 can be positioned along a common plane with the second upper edge 34 of the second aperture 22.

FIG. 5 illustrates a perspective view of the trap 24, in accordance with at least one example of the present disclosure. The trap 24 includes the superior surface 44, the inferior surface 46, and the plurality of apertures 26 extending from the superior surface 44 to the inferior surface 46. In an example, the superior surface 44 and the inferior surface 46 can be substantially parallel to each other. The plurality of apertures 26 can allow for fluid (e.g., rainwater) to pass while capturing debris and preventing the debris from passing through the trap 24. The size, number, and shape of the plurality of apertures 26 can vary and can depend on the desired fluid flow and size of debris to be caught. In the example illustrated in FIG. 5, the plurality of apertures 26 have a circular shape. However, other shapes and sizes can be used.

The trap 24 can have an outer perimeter that substantially matches the shape of the conduit 15. As shown in FIG. 5, the trap 24 has a rectangular shape, which can substantially match the rectangular shape of the conduit 15. The trap 24 can include a first side 57, a second side 51, a third side 47, and a fourth side 45. Similar to the conduit 15, a width of the first side 57 and the second side 51 can be less than a width of the third side 47 and the fourth side 25. While the edges in FIG. 5 are illustrated as 90 degree corners, the edges can also be rounded or similarly configured to match the corners of the conduit 15.

In an example, the surface area of the trap 24 can be maximized such that the trap 24 covers as much cross-sectional area of the conduit 15 as possible. As discussed herein, maximizing the surface area of the trap 24 can maximize debris getting caught above the trap, allow for a greater volume of water flow during heaving rainfall, and minimize the amount debris that passes the trap 24.

In an example, the trap 24 can include a first indentation 54 along the first side 57 of the trap 24 and a second indentation 43 along the second side 51 of the trap. In an example, the first side 57 and the first indentation 54 are directly opposite of the second side 51 and the second indentation 43. As discussed herein, the first side 57 can be positioned adjacent to the first wall 14 of the conduit 15 and the second side 51 can be positioned adjacent to the second wall 18 of the conduit (as shown in FIG. 6).

The first side 57 of the trap 24 can include shoulders 56A, 56B defining the first indentation 54 and the second side 51 of the trap 24 can include shoulders 49A, 49B defining the second indentation 43. In an example, a first indentation length 59 can be at least equal to the first aperture width 33 and a second indentation length 58 can be at least equal to the second aperture width 35.

Figure 7:
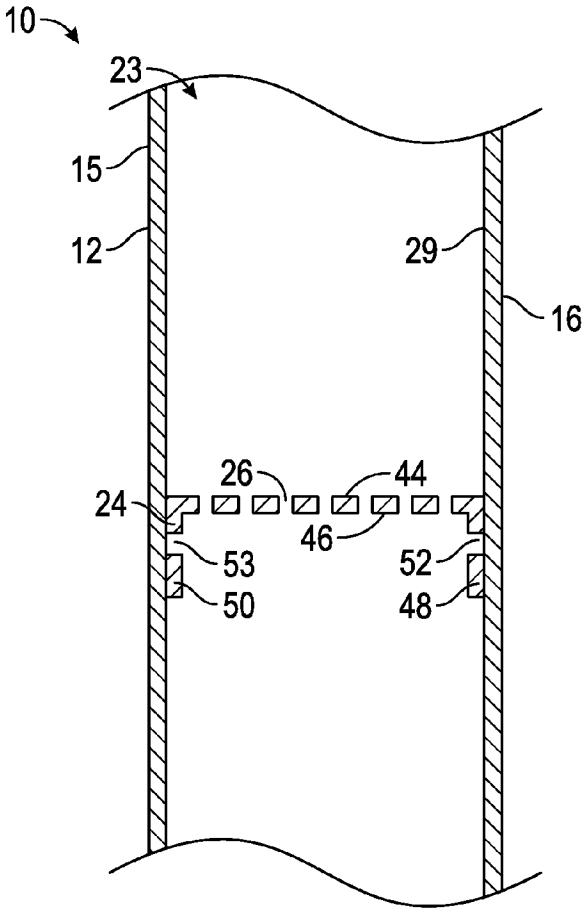
FIG. 7 illustrates a cross-sectional view of the debris trap device along line 5-5, as constructed in accordance with at least one example.

In an example, the trap 24 can include a first tab 50 extending from the inferior surface 46 along the third side 47 of the trap 24 and a second tab 48 extending from the inferior surface 46 along the fourth side 45 of the trap 24. The first and second tabs 50, 48 can extend from the inferior surface 46 in a direction that is substantially perpendicular to the inferior surface 46. As discussed herein, the first tab 50 can be coupled to the third wall 12 of the conduit 15 and the second tab 48 can be coupled to the fourth wall 16 of the conduit 15 (as shown in FIG. 7). In an example, the first tab 50 can include at least one screw hole 53 and the second tab 48 can include at least one screw hole 52 that can receive a screw to couple the trap 24 to the conduit 15. The trap 24 can also be secured within the conduit 15 in other manners, such as rivets, spot-welds, soldering, or adhesives, which may or may not require the first and second tabs 50, 48.

Figure 12:
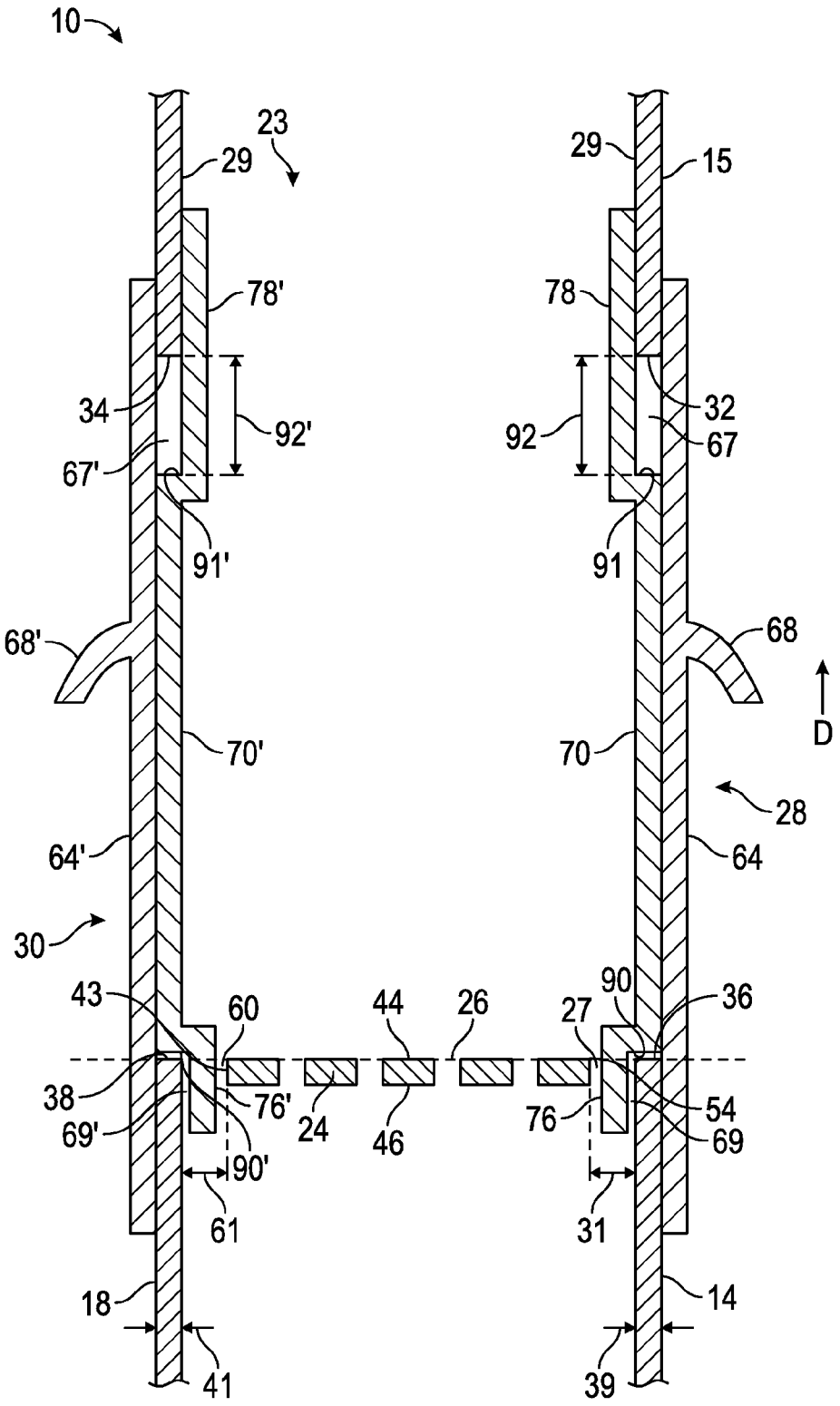
FIG. 12 illustrates a cross-sectional view of a debris trap device, as constructed in accordance with at least one example.

FIG. 6 illustrates a top-down view of the debris trap device 10, in accordance with at least one example of the present disclosure. As illustrated in FIG. 6, the first side 57 of the trap 24 can be adjacent to the first wall 14 of the conduit 15, the second side 51 of the trap 24 can be adjacent to the second wall 18 of the conduit 14, the third side 47 of the trap 24 can be adjacent to the third wall 12 of the conduit 15, and the fourth side 45 of the trap 24 can be adjacent to the fourth wall 16 of the conduit 15. As discussed herein, the surface area of the trap 24 can be maximized to substantially fill the cross-sectional area of the conduit 15. As illustrated in the example of FIG. 6, a first gap 27 is formed between the first wall 14 and the first indentation 53 and a second gap 60 is formed between the second wall 18 and the second indentation 43. The first gap 27 can have a first gap width 31 and the second gap 60 can have a second gap width 61. In an example, the first gap width 31 and the second gap width 61 can be substantially the same. In other examples, the first gap width 31 and the second gap width 61 can be different. As discussed herein, the first gap 27 can receive a portion of the first panel 28 (as shown in FIG. 12) and the second gap 60 can receive a portion of the second panel 30 (as shown in FIG. 12).

FIG. 7 illustrates a cross-sectional view of the debris trap device 10 along line 5-5 (as illustrated in FIG. 1), in accordance with at least one example of the present disclosure. The trap 24 is located within the channel 23 and coupled to the conduit 15. For example, the first tab 50 is positioned adjacent to the third wall 12 and the second tap 48 is positioned adjacent to the fourth wall 16. In an example, the first tab 50 can include at least one screw hole 53 to couple the trap 24 to the conduit 15. For example, the at least one screw hole 53 can receive a screw and couple the first tab 50 to the third wall 12 of the conduit. In an example, the second tab 48 can include at least one screw hole 52 to couple the trap 24 to the conduit 15. For example, the at least one screw hole 52 can receive a screw and couple the second tab 48 to the fourth wall 16 of the conduit.

Figure 8:
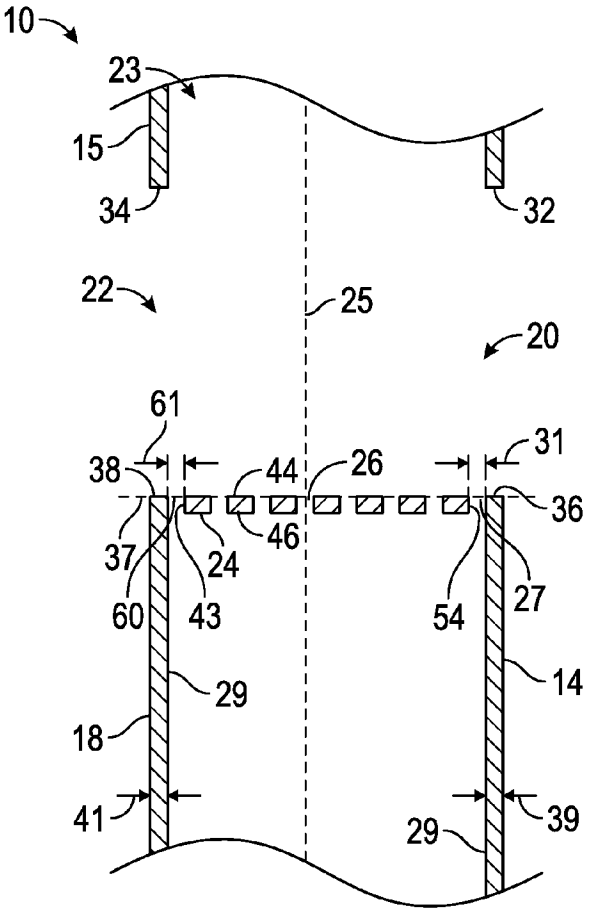
FIG. 8 illustrates a cross-sectional view of the debris trap device along line 6-6, as constructed in accordance with at least one example.

FIG. 8 illustrates a cross-sectional view of the debris trap device 10 along line 6-6 (as illustrated in FIG. 1), in accordance with at least one example of the present disclosure. As discussed herein, the superior surface 44 of the trap 24 can be substantially flush with the first lower edge 36 of the first aperture 20 and the second lower edge 38 of the second aperture 22. For example, the superior surface 44, the first lower edge 36, and the second lower edge 38 can each be located along a common plane 37. The common plane 37 can be substantially perpendicular to a longitudinal axis 25 of the debris trap device 10. Maintaining the superior surface 44 substantially flush with the first lower edge 36 and the second lower edge 38 can assist in removing the debris from the debris trap device 10. For example, if the superior surface 44 is positioned below the first lower edge 36 and the second lower edge 38 by a distance of greater than about, for example, 0.5 inches, the debris can get caught within the conduit 15 during cleanout. As illustrated in the example shown in FIG. 8, the first gap 27 can be formed between the first wall 14 and the trap 24 and the second gap 60 can be formed between the second wall 18 and the trap 24. For example, the first gap 27 can be formed between the interior surface 29 of the first wall 14 and the indentation 54 of the trap 24. In an example, the second gap 60 can be formed between the interior surface 29 of the second wall 18 and the indentation 43 of the trap 24. The first gap 27 and the second gap 60 can be configured to receive a portion of the first panel 28 and the second panel 30, respectively.

Figure 9:
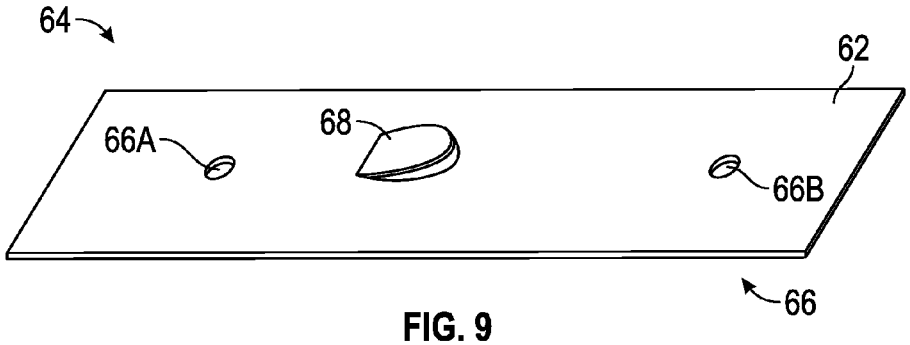
FIG. 9 illustrates a perspective view of a first segment of a first panel, as constructed in accordance with at least one example.
Figure 10:
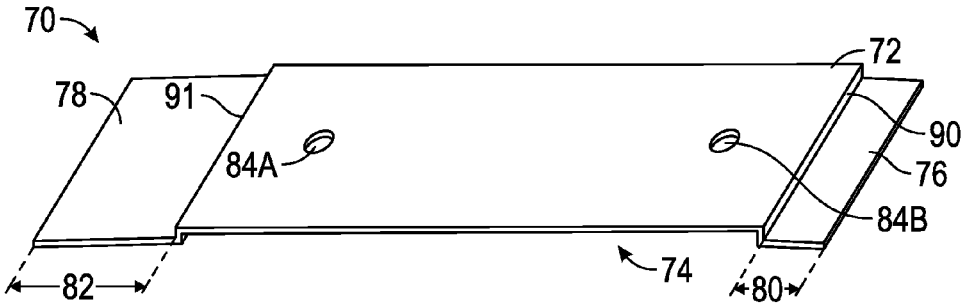
FIG. 10 illustrates a perspective view of a second segment of the first panel, as constructed in accordance with at least one example.
Figure 11:
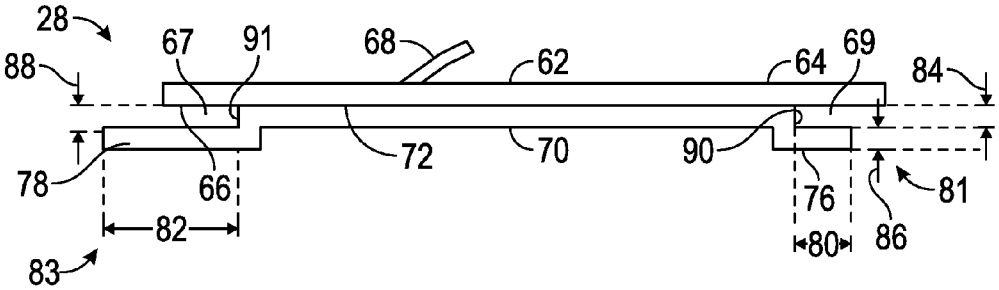
FIG. 11 illustrates a side view of the first panel, as constructed in accordance with at least one example.

As discussed herein, the first panel 28 and the second panel 30 can be identical. Thus, for ease of discussion, FIGS. 9-11 are discussed with reference to the first panel 28. FIG. 9 illustrates a perspective view of a first segment 64 of a first panel 28, in accordance with at least one example of the present disclosure. The first panel 28 can be removably coupled to the first wall 14 of the conduit 15 (as shown in FIGS. 1 and 2. The first segment 64 can include a top surface 62 and a bottom surface 66. In an example, the first segment 64 can include a protrusion 68 (e.g., a tab-like or knob protrusion) extending from the top surface 62, which can assist a user in removing and coupling the first panel 28 to the conduit 15. In an example, the first segment 64 can include at least one screw hole (e.g., screw holes 66A, 66B) to couple with the second segment 70 (shown in FIG. 10). In additional example, the first segment 64 can be secured to the second segment 70 with other fastening methods, such as welding, interlocking features, or adhesives, among others.

FIG. 10 illustrates a perspective view of a second segment 70 of the first panel 28, in accordance with at least one example of the present disclosure. The second segment 70 can include a top surface 72 and a bottom surface 74. In an example, the second segment 70 can include at least one screw hole (e.g., screw holes 84A, 84B) to couple with the first segment 64 (shown in FIG. 9). The second segment 70 can include a first recessed portion 76 and a second recessed portion 78. The first recessed portion 76 can be recessed from the top surface 72 by a first contact shoulder 90 and the second recessed portion 78 can be recessed from the top surface 72 by a second contact shoulder 91. In an example, a first recessed portion length 80 can be less than a second recessed portion length 82. In another example, the first recessed portion length 80 can be equal to the second recessed portion length 82 or the first recessed portion length 80 can be greater than the second recessed portion length 82.

FIG. 11 illustrates a side view of the first panel 28, in accordance with at least one example of the present disclosure. The first segment 64 and the second segment 70 are coupled together. For example, the top surface 72 of the second segment 70 can contact the bottom surface 66 of the first segment 64. The first recessed portion 76 and the second recessed portion 78 are not in contact with the bottom surface of the first segment 64. In an example, the first segment 64 and the second segment 70 can be coupled together in an offset manner, such that the first recessed portion 76 does not extend beyond the first segment 64 and the second recessed portion 78 extends beyond the first segment 64. While the first panel 28 is illustrated as having the first segment 64 coupled to the second segment 70, the first panel 28 can be formed from a single piece.

The first panel 28 can include a first end 81 and a second end 83. In an example, the first end 81 can include a first panel gap 69. The first panel gap 69 can be configured to receive a portion of the first wall 14 of the conduit 15 (shown in FIG. 12). In an example, the first panel gap thickness 84 can be greater than the first wall thickness 39 (as shown in FIG. 12). In an example, the first recessed portion 76 can be positioned within the first gap 27 between the first wall 14 and the trap 24. Thus, a first recessed portion thickness 86 can be less than a first gap thickness 31.

In an example, the second end 83 can include a second panel gap 67. The second panel gap 67 can be configured to receive a portion of the first wall 14 of the conduit 15 (shown in FIG. 12). In an example, the second panel gap thickness 88 can be greater than the first wall thickness 39 (as shown in FIG. 12). In an example, the second recessed portion 78 can be positioned within the channel 23 of the conduit 15.

FIG. 12 illustrates a cross-sectional view of a debris trap device 10, in accordance with at least one example of the present disclosure. The debris trap device 10 includes the conduit 15 defining a channel 23. The trap 24 can be located within the channel 23 and coupled to the conduit 15 (e.g., an interior surface 29 of the conduit 15). As illustrated in FIG. 12, the first panel 28 is removably coupled to the first wall 14 and the second panel 30 is removably coupled to the second wall 18. The first panel gap 69 can receive a portion of the first wall 14 and the first recessed portion 76 can be positioned within the first gap 27 between the first wall 14 and the trap 24. For example, the first recessed portion 76 can be positioned between the interior surface 29 and the first indentation 54. Thus, the first gap thickness 31 can be greater than a first recess portion thickness 86. When the first panel 28 is removably coupled to the first wall 14, the first contact shoulder 90 can contact the first lower edge 36 of the first aperture 20.

As illustrated in FIG. 12, the second panel gap 67 can receive a portion of the first wall 14. For example, the second panel gap 67 can receive the first upper edge 32 of the first aperture 20. When the first panel 28 is removably coupled to the first wall 14, a space is formed between the second contact shoulder 91 and the first upper edge 32. A length 92 of the space can be greater than the first recessed portion length 80 (as shown in FIG. 11) to facilitate removable coupling the first panel 28 to the first wall 14. For example, a user can raise the first panel 28 using the protrusion 68 to move the first panel in direction "D" such that the second contact shoulder 91 contacts the first upper edge 32. When the first upper edge 32 contacts the second contact shoulder 91, the first recessed portion 76 will no longer be positioned within the gap 27 and the first panel 28 can be removed.

As illustrated in FIG. 12, the second panel 30 can be removably coupled to the second wall 18. The first panel gap 69' can receive a portion of the second wall 18 and the first recessed portion 76' can be positioned within the second gap 60 between the second wall 18 and the trap 24. For example, the first recessed portion 76' can be positioned between the interior surface 29 and the second indentation 43. Thus, the second gap thickness 61 can be greater than a first recess portion thickness 86'. When the second panel 30 is removably coupled to the second wall 18, the first contact shoulder 90' can contact the second lower edge 38 of the second aperture 22.

As illustrated in FIG. 12, the second panel gap 67' can receive a portion of the second wall 18. For example, the second panel gap 67' can receive the second upper edge 34 of the second aperture 22. When the second panel 30 is removably coupled to the second wall, a space is formed between the second contact shoulder 91' and the second upper edge 34. A length 92' of the space can be greater than the first recessed portion length 80 (as shown in FIG. 11) to facilitate removable coupling the second panel 30 to the second wall 18. For example, a user can raise the second panel 30 using the protrusion 68' to move the second panel 30 in direction "D" such that the second contact shoulder 91' contacts the second upper edge 34 contacts. When the second upper edge 34 contacts the second contact shoulder 91', the first recessed portion 76' will no longer be positioned within the gap 60 and the second panel 30 can be removed.

Figure 13:
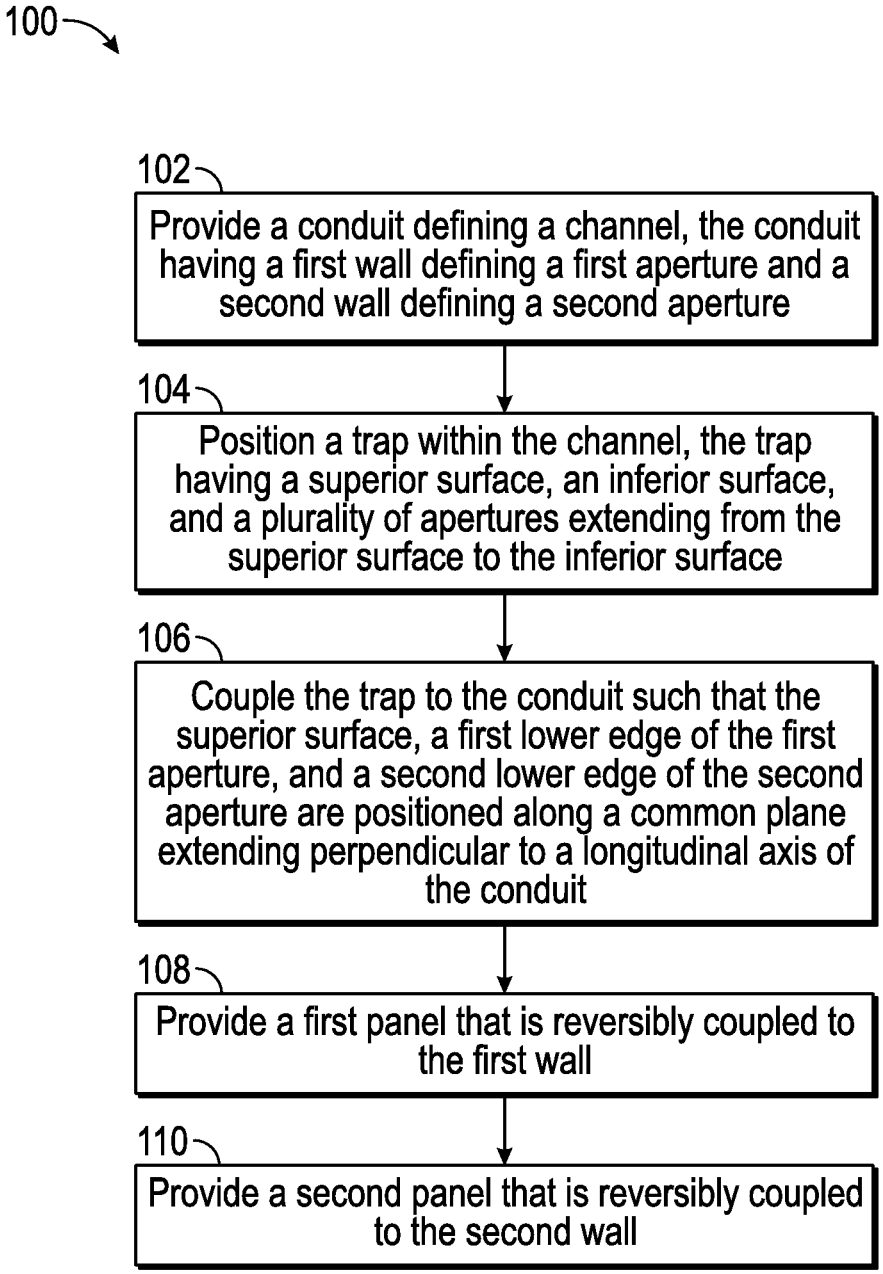
FIG. 13 is a flowchart illustrating an example method of forming a debris trap device, as constructed in accordance with at least one example.

FIG. 13 is a flowchart illustrating an example method 100 of forming a debris trap device 10, in accordance with at least one example of the present disclosure. The method 100 can include providing a conduit defining a channel at 102, positioning a trap within the channel at 104, coupling the trap to the conduit at 106, providing a first panel at 108, and providing a second panel at 110.

The method 100 can begin at 102 with providing a conduit. For example, the method 100 can include providing the conduit 15. As discussed herein with respect to FIG. 1, the conduit 15 can define a channel 23 and have a first wall 14 defining a first aperture 20 and a second wall 18 defining a second aperture 22, where the first aperture 20 is directly opposite the second aperture 22.

At 104, the method 100 continues with positioning a trap within the channel. For example, the method 100 can include positioning trap 24 within the channel 23, as shown in FIG. 1. As discussed herein with respect to FIG. 5, the trap 24 can have a superior surface 44, an inferior surface 46, and a plurality of apertures 26 extending from the superior surface 44 to the inferior surface 46. The trap can include a first indentation 54 along a first side 57 of the trap 24 and a second indentation 43 along a second side 51 of the trap 24, as shown in FIG. 5. The second side 51 can be directly opposite the first side 57. The trap 24 can include a first tab 50 extending from the inferior surface 46 along a third side 47 of the trap 24 and a second tab 48 extending from the inferior surface 46 along a fourth side 45 of the trap 24. The fourth side 45 can be directly opposite the third side 47. In an example, positioning the trap 24 within the channel 23 can include positioning the first side 57 of the trap 24 adjacent to the first wall 14 of the conduit 15 and positioning the second side 51 of the trap 24 adjacent to the second wall 18 of the conduit 15, as shown in FIG. 6.

At 106, the method 100 can include coupling the trap to the conduit. For example, the method 100 can include coupling the trap 24 to the conduit 15, as shown in FIG. 1. As discussed herein with respect to FIGS. 6-8, the trap 24 can be coupled to the conduit 15 such that the superior surface 44, a first lower edge 36 of the first aperture 20, and a second lower edge 38 of the second aperture 22 are positioned along a common plane 37 extending perpendicular to a longitudinal axis 25 of the conduit 15. In an example, coupling the trap 24 to the conduit 15 can include coupling the first tab 50 to a third wall 12 of the conduit 15 and coupling the second tab 48 to a fourth wall 16 of the conduit 18. The third wall 12 can be directly opposite the fourth wall 16.

At 108, the method 100 can include providing a first panel. For example, the method 100 can include providing the first panel that is removably coupled to the first wall 14, as shown in FIGS. 1, and 9-12. At 110, the method 100 can include providing a second panel. For example, the method 100 can include providing the second panel 30 that is removably coupled to the second wall 18.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown and described. However, the present inventors also contemplate examples in which only those elements shown and described are provided.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

What is claimed is:

1. A debris trap device, comprising:

a conduit defining a channel forming an inlet opening to receive fluid and debris and an outlet opening to discharge at least the fluid, the conduit including a first wall defining a first aperture and a second wall defining a second aperture directly opposite of the first aperture;

a trap including a superior surface, an inferior surface, and a plurality of apertures extending from the superior surface to the inferior surface, the trap positioned within the channel and coupled to the conduit such that the superior surface is substantially flush with a first lower edge of the first aperture and a second lower edge of the second aperture, wherein the trap includes a first indentation along a first side of the trap and a second indentation along a second side of the trap, the second side directly opposite the first side, wherein a first indentation length is at least equal to a first aperture width and a second indentation length is at least equal to a second aperture width, and wherein a first gap is formed between the first wall and the first indentation and a second gap is formed between the second wall and the second indentation;

a first panel removably coupled to the first aperture; and a second panel removably coupled to the second aperture.

2. The debris trap device of claim 1, wherein the first side is positioned adjacent to the first wall of the conduit and the second side is positioned adjacent to the second wall of the conduit.

3. The debris trap device of claim 1, wherein the trap includes a first tab extending from the inferior surface along a third side of the trap and a second tab extending from the inferior surface along a fourth side of the trap.

4. The debris trap device of claim 3, wherein the first tab and the second tab extend in a direction that is substantially perpendicular to the inferior surface and substantially parallel to a longitudinal axis of the conduit.

5. The debris trap device of claim 3, wherein the first tab is coupled to a third wall of the conduit and the second tab is coupled to a fourth wall of the conduit, the third wall directly opposite of the fourth wall.

6. The debris trap device of claim 1, wherein the first panel and the second panel include a first segment coupled to a second segment.

7. The debris trap device of claim 6, wherein the second segment includes a first recessed portion and a second recessed portion.

8. The debris trap device of claim 6, wherein the first panel and the second panel include a first panel gap at a first end of the first panel and a first end of the second panel and a second panel gap at a second end of the first panel and a second end of the second panel.

9. The debris trap device of claim 8, wherein a first panel gap width is greater than a first wall thickness and a second panel gap width is greater than a second wall thickness.

10. The debris trap device of claim 9, wherein the first panel and the second panel include a protrusion extending from a top surface of the first segment.

11. A downspout system, comprising:

a downspout defining a first channel and having a first inlet opening configured to be coupled to a gutter and to receive fluid and debris collected in the gutter and a first outlet opening to discharge the fluid from the downspout; and a debris trap device coupled to the downspout, the debris trap device including:

a conduit defining a second channel forming a second inlet opening and a second outlet opening, the second inlet opening coupled to a first portion of the downspout and the outlet opening coupled to a second portion of the downspout;

a first wall of the debris trap device defining a first aperture and a second wall of the debris trap device defining a second aperture, the second aperture directly opposite the first aperture;

a trap including a superior surface, an inferior surface, and a plurality of apertures extending from the superior surface to the inferior surface, the trap positioned within the second channel and coupled to the conduit, wherein the trap includes a first indentation along a first side of the trap and a second indentation along a second side of the trap, wherein a first gap is formed between the first wall and the first indentation and a second gap is formed between the second wall and the second indentation;

a first panel removably coupled to the first wall; and a second panel removably coupled to the second wall, wherein the debris trap device is positioned between the first inlet opening of the downspout and the first outlet opening of the downspout.

12. The downspout system of claim 11, wherein the superior surface of the trap is substantially flush with a first lower edge of the first aperture and a second lower edge of the second aperture.

13. A method comprising:

providing a conduit defining a channel, the conduit having a first wall defining a first aperture and a second wall defining a second aperture, wherein the first aperture is directly opposite the second aperture;

positioning a trap within the channel, the trap having a superior surface, an inferior surface, and a plurality of apertures extending from the superior surface to the inferior surface, wherein the trap includes a first indentation along a first side of the trap and a second indentation along a second side of the trap, the second side directly opposite the first side, wherein a first indentation length is at least equal to a first aperture width and a second indentation length is at least equal to a second aperture width, and wherein a first gap is formed between the first wall and the first indentation and a second gap is formed between the second wall and the second indentation;

coupling the trap to the conduit such that the superior surface, a first lower edge of the first aperture, and a second lower edge of the second aperture are positioned along a common plane extending perpendicular to a longitudinal axis of the conduit;

providing a first panel that is removably coupled to the first wall; and providing a second panel that is removably coupled to the second wall.

14. The method of claim 13, wherein the trap includes a first tab extending from the inferior surface along a third side of the trap and a second tab extending from the inferior surface along a fourth side of the trap, the fourth side directly opposite the third side.

15. The method of claim 14, wherein positioning the trap within the channel includes positioning the first side of the trap adjacent to the first wall of the conduit and positioning the second side of the trap adjacent to the second wall of the conduit.

16. The method of claim 14, wherein coupling the trap to the conduit includes coupling the first tab to a third wall of the conduit and coupling the second tab to a fourth wall of the conduit, wherein the third wall is directly opposite the fourth wall.

* * * * *